United States Patent [19]

Barresi et al.

[11] Patent Number: 4,852,504

[45] Date of Patent: Aug. 1, 1989

[54] WASTE FUEL INCINERATION SYSTEM

[75] Inventors: James A. Barresi, Castle Hill; Kenneth C. Arndt, Presque Isle; Michael N. Young, Washburn; Daniel O. Bridgeham, Mapleton; Howard H. Hede, Stockholm, all of Me.

[73] Assignee: First Aroostook Corporation, Caribou, Me.

[21] Appl. No.: 209,703

[22] Filed: Jun. 20, 1988

[51] Int. Cl.[4] ..... F23G 7/06

[52] U.S. Cl. ..... 110/346; 110/187; 110/255; 110/190; 110/263; 122/4 D

[58] Field of Search ..... 110/185, 186, 187, 188, 110/190, 191, 245, 263, 255, 257, 258, 259, 266, 109, 114, 346, 203, 210, 211, 212, 214, 165 R

[56] References Cited

U.S. PATENT DOCUMENTS

| | | | |
|---|---|---|---|
| 3,568,609 | 3/1971 | Stockman . | |
| 3,855,950 | 12/1974 | Hughes et al. | 110/109 X |
| 3,863,779 | 2/1975 | Stockman | 110/109 |
| 3,877,589 | 4/1975 | Stockman | 110/109 |
| 4,013,023 | 3/1977 | Lombana et al. | 110/187 |
| 4,074,638 | 2/1977 | Miller | 110/259 |
| 4,211,186 | 7/1980 | Pearce | 122/4 D |
| 4,241,672 | 12/1980 | Tuttle | 110/187 X |
| 4,315,468 | 2/1982 | Tyer et al. | 110/190 X |
| 4,389,978 | 6/1983 | Northcote | 122/4 D |
| 4,448,134 | 5/1984 | Foote | 110/263 X |
| 4,452,611 | 6/1984 | Richey | 110/255 X |
| 4,474,121 | 10/1984 | Lewis | 110/188 X |
| 4,592,289 | 6/1986 | Pershing et al. | 110/188 X |
| 4,702,178 | 10/1987 | Welsh | 110/185 X |

*Primary Examiner*—Henry C. Yuen
*Attorney, Agent, or Firm*—Daniel H. Kane, Jr.

[57] ABSTRACT

A waste fuel incineration process and system operates at very high temperatures with excess under fire air for high efficiency combustion of waste as a fuel and for decomposition of any toxic waste. The system is applicable for clean burning volume reduction of waste and for power generation and co-generation of heat. The control elements are constructed and arranged and the control circuit programmed for maintaining the primary combustion temperature at a target temperature selected in the range of approximately 1600°–1800° F. (871°–982° C.), for turning on and increasing under fire air to bring the primary combustion chamber flue gasses up to the target temperature, for maintaining the volume rate of flow of under fire air at 150% to 250% of the stoichiometric requirement for complete combustion at normal load, for reducing and turning off under fire air in a first over-temperature range extending above the target temperature, for turning on and increasing over fire air for diluting and cooling flue gasses in a second over-temperature range extending above the first over-temperature range, and for shutting down the under fire air, over fire air and waste fuel feeding cylinder and piston at a selected absolute over-temperature. A variety of safety features are disclosed including a normally closed dump stack on the secondary tower which automatically opens for natural by pass drafting in the event of power failure or excess temperature in the pollution control device. A live "V" shaped gravel bed and ash ram permits removal of slagged gravel for renewing the surface of the hearth.

34 Claims, 9 Drawing Sheets

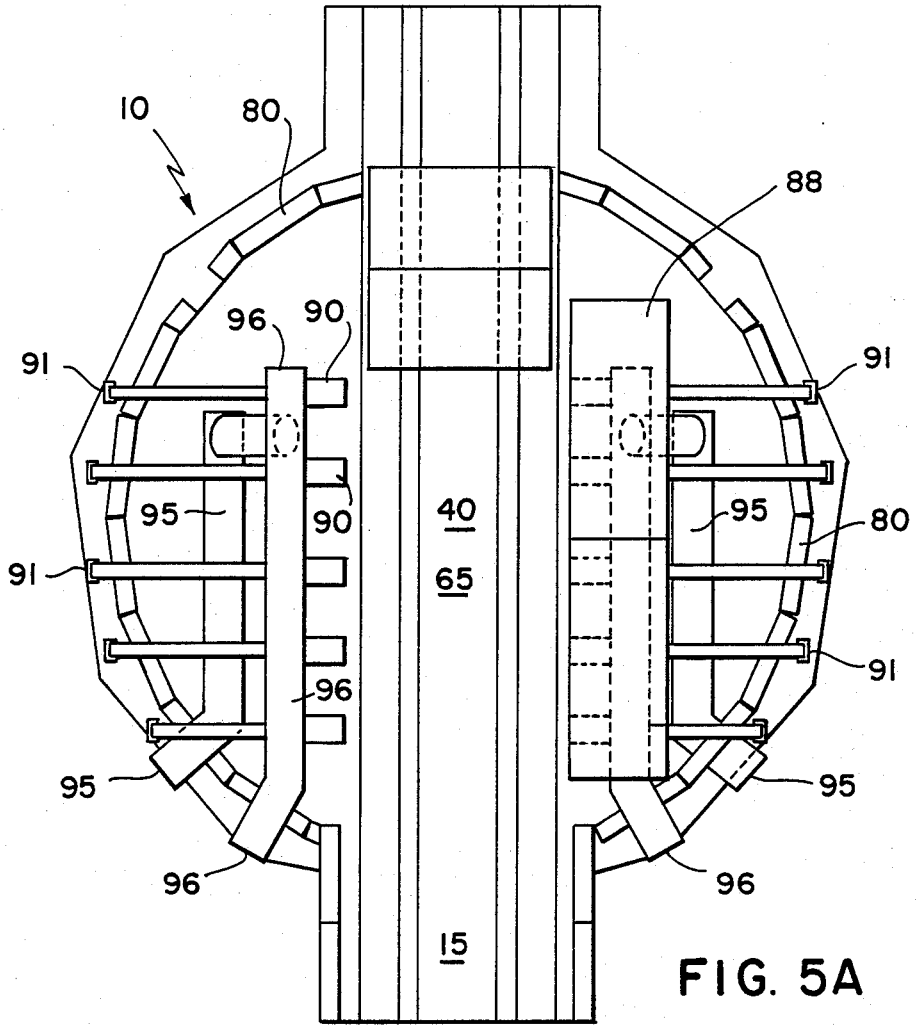
FIG. 5A
FIG. 5B
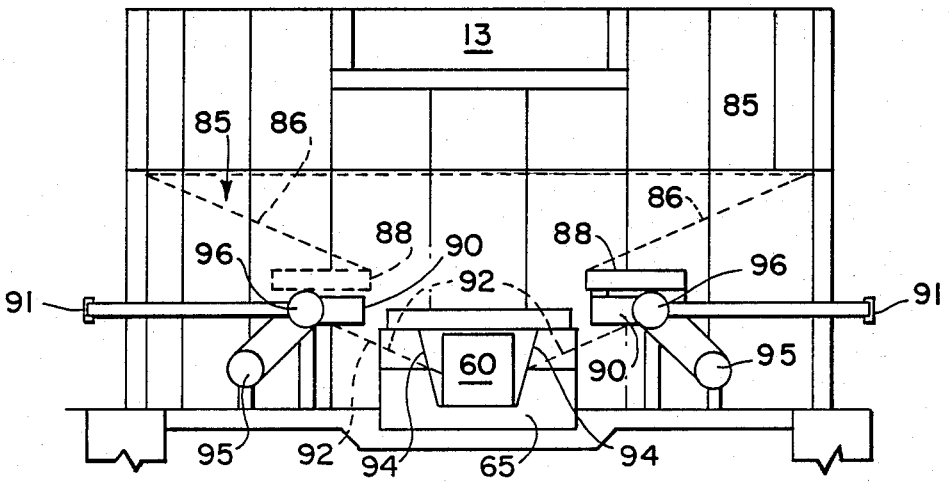

WASTE FUEL INCINERATION SYSTEM

TECHNICAL FIELD

This invention relates to a new waste fuel incineration process and system for high efficiency combustion of waste as a fuel. The invention provides an incinerator process which operates with excess air combustion and at very high temperatures for decomposition of any toxic wastes. The system is applicable for clean burning volume reduction of waste and for power generation and co-generation of heat.

BACKGROUND ART

Incineration of waste for reduction of volume has generally been conducted at temperatures in the range of for example 1000° F. (538° C.), too low for decomposition of all toxic materials. Even with incineration combustion in higher ranges of 1000°-1400° F. (538°-760° C.) the temperature may be insufficient for complete breakdown of complex or hazardous materials. Furthermore, such temperatures are not as useful for power generation and co-generation of heat as are even higher combustion temperatures.

In waste incinerators the "starved air" or "controlled air" method of trash burning is often used for pyrolysis of waste and for recovery of identified chemicals or pollutants before discharge of flue gasses. A starved air refuse incinerator is described in the Stockman U.S. Pat. No. 3,568,609 having a level bed or layer of sand on the bottom of the combustion chamber. The sand rests over an ash removal opening and is "drained", dropped, or removed from below through the bottom opening to lower the level of the sand and therefore the level of ash accumulating in the combustion chamber. The sand bed blocks air entry or air flow back in through the bottom opening to the combustion chamber, maintaining the "starved air-combustion conditions.

The Hughes et al. U.S. Pat. No. 3,855,950 is concerned with both continuous loading or feeding of waste fuel and continuous ash removal without changing the controlled air or starved air combustion chamber conditions. Hughes et al. describe "pusher members" for pushing waste material in a chute through a "guillotine type firedoor." A control system operates the hopper loader door, guillotine fire door, and pusher members in the feed chute so that atmospheric air cannot enter the combustion chamber during automatic operation. Similarly an ash pusher at the bottom of an ash drop shaft or duct below the combustion chamber blocks the ash duct when extended to prevent return flow of air. There is no ram or pusher in the combustion chamber itself for removing ash.

The Miller U.S. Pat. No. 4,074,638 describes another pyrolytic incinerator operating on a starved air principal in which there is no air introduced directly into the combustion chamber. Miller describes an hydraulic ram which pushes waste material from a hopper through a guillotine type door into the combustion chamber. Ash cleanout cylinders are described mounted on pairs of wheels on two opposite sides that bear against two sides or opposing surfaces of a housing.

The McRee, Jr., U.S. Pat. No. 4,354,440 describes an under fire air incinerator process in which the under fire system supplies air at less than stoichiometric requirements. An exothermic reaction is created between some of the fixed carbon in the waste material and the starved air oxygen to produce volatiles. Steam is supplied for creating an endothermic "water-gas reaction."

The Stockman U.S. Pat. No. 3,877,589 describes an incinerator loader with waste material compaction drive rams carried on wheels that ride on upper and lower opposing walls of a feed cylinder. The Stockman U.S. Pat. No. 3,863,779 describes another ram type refuse loader in which a complex carriage structure supports the compaction ram. The ram is guided both vertically and horizontally by rollers which bear on the inner walls of an elongate housing.

Applicants have designed an excess air, under fire air, waste fuel incinerator presently operating in Frenchville, Maine. This prior art incinerator is designed to operate in the primary combustion temperature range of 1000°-1400° F. (538°-760° C.) and not the very high temperatures and excess air ranges contemplated by the present invention. Nor does the Frenchville, Maine incinerator incorporate the control system, control methods, and safety features for controlling over temperatures that may occur during primary combustion at such very high temperatures. The present invention also provides additional improvements in waste fuel feeding and ash removal.

OBJECTS OF THE INVENTION

It is therefore an object of the present invention to provide a new waste fuel incinerator process and system which operates at very high temperatures for example in the range of 1600°-1800° F. (871°-982° C.) for complete combustion, breakdown and decomposition of any toxic chemicals or materials.

Another object of the invention is to provide a waste fuel incinerator operating with excess under fire air, for example at a volume rate in the range of approximately 150% to 250% of the stoichiometric combustion requirements for maintaining very high combustion temperatures and complete combustion and breakdown of waste materials.

A further object of the invention is to provide a very high temperature excess under fire air waste fuel incinerator system and process with backup safety features and a control system and control methods to control over-temperatures in the primary combustion chamber in excess of the very high target temperature.

The invention also is intended to provide a waste fuel incineration system at very high temperatures with novel waste fuel feed and ash and slag removal features.

DISCLOSURE OF THE INVENTION

In order to accomplish these results the present invention provides a primary combustion chamber having a fuel feeding inlet at a first upper level and a waste fuel combustion hearth at a second intermediate level or hearth level. A plurality of under fire air inlet passageways are positioned at the hearth level of the primary combustion chamber for introducing under fire air into waste fuel on the hearth during combustion. A plurality of fans and fan motors respectively coupled to the under fire air inlet passageways establish the under fire airflows, and a plurality of dampers and damper motors differentially control the volume rate of flow of under fire air through the respective under fire air passageways.

The under fire air inlets are distributed for balanced flow of air at the hearth level into the waste fuel. Furthermore the under fire air inlet passageways, fans and fan motors, and dampers and damper motors are constructed and arranged for delivering 150% to 250% of the stoichiometric requirements for complete combustion of waste fuel during operation of the primary combustion chamber at normal load. A feature and advantage of this arrangement is that the primary combustion temperature may be maintained at a very high temperature level for complete combustion and breakdown of waste materials. Furthermore the very high temperatures are available for power generation and co-generation of heat.

One or more over fire air inlet passageways are also provided, positioned in the pathway of flue gasses from primary combustion. Over fire fans and fan motors establish the over fire airflows while over fire dampers and damper motors differentially control the volume rate of flow of over fire air for selectively cooling and diluting flue gasses in response to over-temperature control steps.

A waste fuel feeding cylinder and piston delivers charges of waste fuel to the primary chamber. The cylinder is an elongate waste fuel feed chute having a volume capacity defining a charge of waste fuel. A hopper opening is provided for loading the feed chute with a door for closing the hopper opening. The piston is in the form of a ram and ram drive for extending the ram substantially the length of the feed chute for feeding a charge of waste fuel into the primary combustion chamber at the upper level. A guillotine door with appropriate construction arrangements isolates the charge of waste fuel from the primary combustion chamber temperatures.

An ash ram is positioned at the base of the hearth of the primary combustion chamber and an ash ram drive advances the ash ram across the base of the hearth for removing ash and slag. Ash and slag are delivered through an ash tunnel from the primary combustion chamber to an ash pit at a third lower level coupled to the ash tunnel for receiving and storing ashes.

According to the invention a first cross-over passageway leads from the primary combustion chamber to the lower half of a secondary tower. The secondary tower is formed with diameter, height, and volume dimensions for reducing the impedance of the flue gas flow and slowing the flue gas flow, drafting flue gasses upward through the secondary tower, settling fly ash, substantially completing combustion with the excess air, and radiating heat and cooling the flue gasses.

One of the safety features provided by the invention is a dump stack and dump stack loader positioned at the top of the secondary tower. The dump stack damper is normally closed to prevent natural draft through the dump stack and constrain the draft of flue gasses to a second cross-over passageway. The second cross-over passageway leads from the top of the secondary tower to the top of a cooling tower. The cooling tower includes spray lances for spraying cooling material such as water for cooling flue gasses drafted through the cooling tower to an outlet at the base of the cooling tower.

According to the invention a safety damper is positioned in the second cross-over passageway. The safety damper is normally open for drafting flue gasses from the secondary tower through the cooling tower. However the safety damper is operatively coupled to the dump stack damper for automatically closing when the dump stack damper opens thereby constraining flue gas flow to the natural draft through the dump stack in response to safety control steps.

A pollution control device is operatively coupled to the flue gas outlet at the base of the cooling tower. An induced draft fan actively induces a draft through the pollution control device, cooling tower, and secondary tower from the primary combustion chamber. The induced draft fan delivers flue gasses to a chimney for drafting and disbursing the flue gasses at a desired elevation.

In the preferred example embodiment the incinerator includes a first control phase. A microprocessor is operatively coupled to the under fire air fan motors and under fire air damper motors, over fire air fan motors and over fire air damper motors, and waste fuel feeding cylinder and piston. The first control phase is programmed for maintaining the primary combustion temperature in the primary combustion chamber at a target temperature in the very high temperature range of approximately 1600°-1800° F. (871°-982° C.). A first temperature sensor is strategically positioned for sensing the temperature of flue gasses from primary combustion. The sensed temperature is compared with the target temperature for turning on and increasing under fire air to bring the primary combustion chamber flue gasses up to the target temperature.

The first control phase is also programmed for reducing and turning off under fire air in a first over-temperature range extending above the target temperature. Over fire air is turned on and increased through a second over-temperature range extending above the first over-temperature range. Finally the under fire air, over fire air and waste fuel feeding cylinder and piston are shut down at a selected absolute over-temperature.

In the preferred embodiment the first control phase is programmed with a first over temperature range comprising approximately 1800°-2000° F. (982°-1093° C.), a second over-temperature range comprising approximately 2000°-2100° F. (1093°-1143° C.) and an absolute over-temperature selected to be approximately at least 2100° F. (1149° C.). The target temperature is programmed in the preferred primary combustion temperature range of 1700°-1800° F. (927°-982° C.).

A second control phase provides intercoupling between the normally closed dump stack damper, the normally open second cross-over damper, the induced draft fan, the pollution control device, and a second temperature sensor positioned in the vicinity of the pollution control device for determining flue gas temperature at the pollution control device and comparing it with a safety limit temperature. The second temperature sensor is operatively coupled to turn off the induced draft fan, open the dump stack damper, close the second cross-over damper and turn off the pollution control device at the safety limit temperature or at temperatures in excess of the safety temperature. In the event of power failure in the delivery of power to the components of the waste fuel incinerator system, the second control phase also assures that the dump stack damper opens while the second cross-over passageway damper closes. A feature and advantage of this arrangement is that any flue gasses from smoldering or pyrolysis during the power failure condition will be safely vented by natural or gravity drafting through the dump stack.

According to another novel feature of the invention the primary combustion chamber hearth is formed by a live "V" shaped gravel bed hearth with inclined gravel surfaces and an elongate ash ram positioned at the apex at the base of the "V". Hydraulic drive is provided for advancing the elongate ash ram along the apex at the base of the "V" shaped gravel bed for removing a layer of gravel and slag formed on the gravel along with ashes. The ash slag and gravel mixture pass through an ash tunnel to an ash pit at a third lower level where the ashes are safely stored.

A feature of this arrangement is that the "live" gravel bed of the hearth may be renewed and destructive slag removed by removing a layer of the slagged gravel along the surface of the hearth along with ashes by operation of the ash ram. The gravel may be replenished by feeding new gravel into the primary combustion chamber and hearth through the waste fuel feed chute at the upper level. The destruction of a fixed bed hearth by slag is therefore avoided.

In the preferred embodiment the "V" shaped gravel bed hearth is actually a double "V" bed hearth having an upper level "V" shaped bed of first and second inwardly inclined gravel sides terminating in respective first and second ledges or shelves. These shelves are spaced apart over the track or line of travel of the ash ram at the base of the hearth. The under fire air inlet passageways are positioned below the respective shelves free of interference from the gravel bed. A lower level "V" shaped bed of first and second inwardly inclined gravel sides is formed below the respective shelves and below the under fire air inlet passageways. The lower level inwardly inclined gravel sides slope into the path of the ash ram for removal of a layer of gravel with each advance of the ash ram.

The elongate waste fuel feed chute in the preferred embodiment is formed with four sides forming an elongate waste fuel feed cylinder of rectangular cross-section. The waste fuel feed ram is formed in complementary rectangular cross-section configuration with rollers mounted on all four sides bearing on all four sides of the cylinder for bearing irregular forces generated during feeding of heterogeneous waste fuel.

The waste fuel feed ram is a telescoping ram of multiple telescoping sections. The hydraulic cylinder ram drive extends the telescoping sections for feeding a charge of waste fuel into the primary combustion chamber.

The invention contemplates a variety of novel steps including blowing under fire air at multiple locations at approximately the hearth level into the waste fuel and blowing excess under fire air at a volume rate in the range of approximately 150% to 250% of the stoichiometric requirement for complete combustion during operation of the primary combustion chamber at normal load. The invention also contemplates sensing the temperature of flue gasses from primary combustion and controlling the flow of under fire air to maintain combustion temperature in the primary combustion chamber at a target temperature in the temperature range of approximately 1600°–1800° F. (871°–982° C.).

Other novel control steps include comparing the sensed temperature of the primary combustion flue gasses with the target temperature and incrementally damping down and reducing the flow of the under fire air as the combustion temperature exceeds the target temperature in a first over-temperature range extending above the target temperature, and turning off the under fire air at the top of the first over-temperature range. Additional control steps include turning on and blowing over fire air into the flue gasses from primary combustion to cool and dilute the flue gasses as the sensed temperature falls within a second over-temperature range extending above the first over-temperature range. A final step in temperature control includes shutting down the under fire air, the over fire air, and the waste fuel feeding, causing a starved air condition of smoldering in the primary combustion chamber for lowering the temperature of primary combustion flue gasses if the sensed temperature reaches or exceeds an absolute over-temperature.

In the event of electrical power failure or if the temperature of the flue gasses in the pollution control device exceed a safety limit temperature, the invention contemplates shutting down the induced draft fan, automatically opening the normally closed dump stack damper at the top of the secondary tower for gravity drafting secondary flue gasses to the atmosphere through the dump stack, and automatically closing the normally open damper in the second cross-over passageway thereby confining drafting of flue gasses to the dump stack.

Other novel control steps according to the present invention are summarized above and set forth in further detail in the following specification and accompanying drawings.

BRIEF DESCRIPTION OF THE DRAWINGS

FIG. 5A is a breakaway fragmentary plan view of the primary combustion chamber with the upper courses of refractory olivine panels removed showing the layout of under fire air inlet passageways at the hearth level.

FIG. 5B is a fragmentary breakaway front view of the primary combustion chamber with the front wall of refractory olivine panels removed showing the layout of the under fire air inlet passageways and the double "V" shaped gravel bed hearth.

DESCRIPTION OF PREFERRED EXAMPLE EMBODIMENTS & BEST MODE OF THE INVENTION

Figure 1:
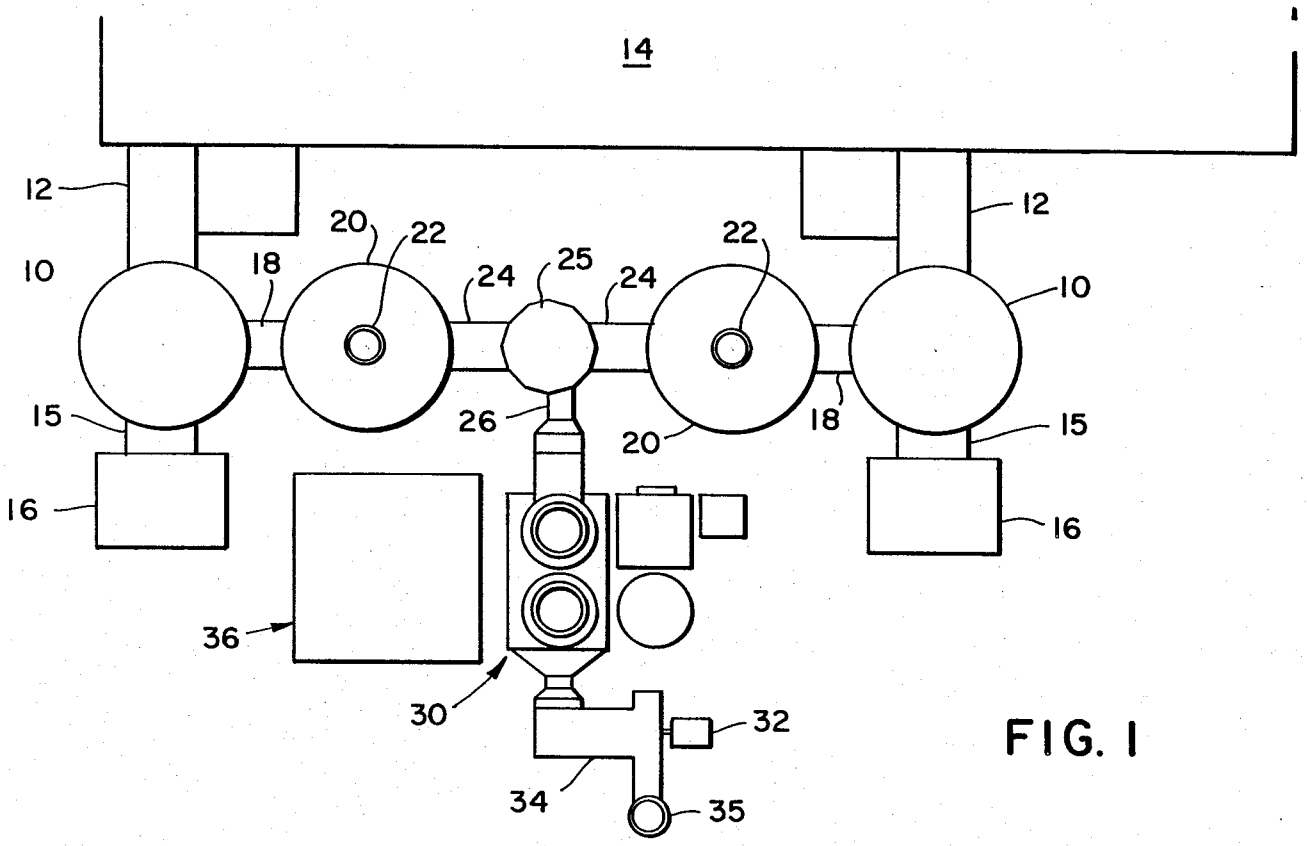
FIG. 1 is a diagrammatic plan view of the major components of a waste fuel incinerator system according to the present invention.
Figure 2:
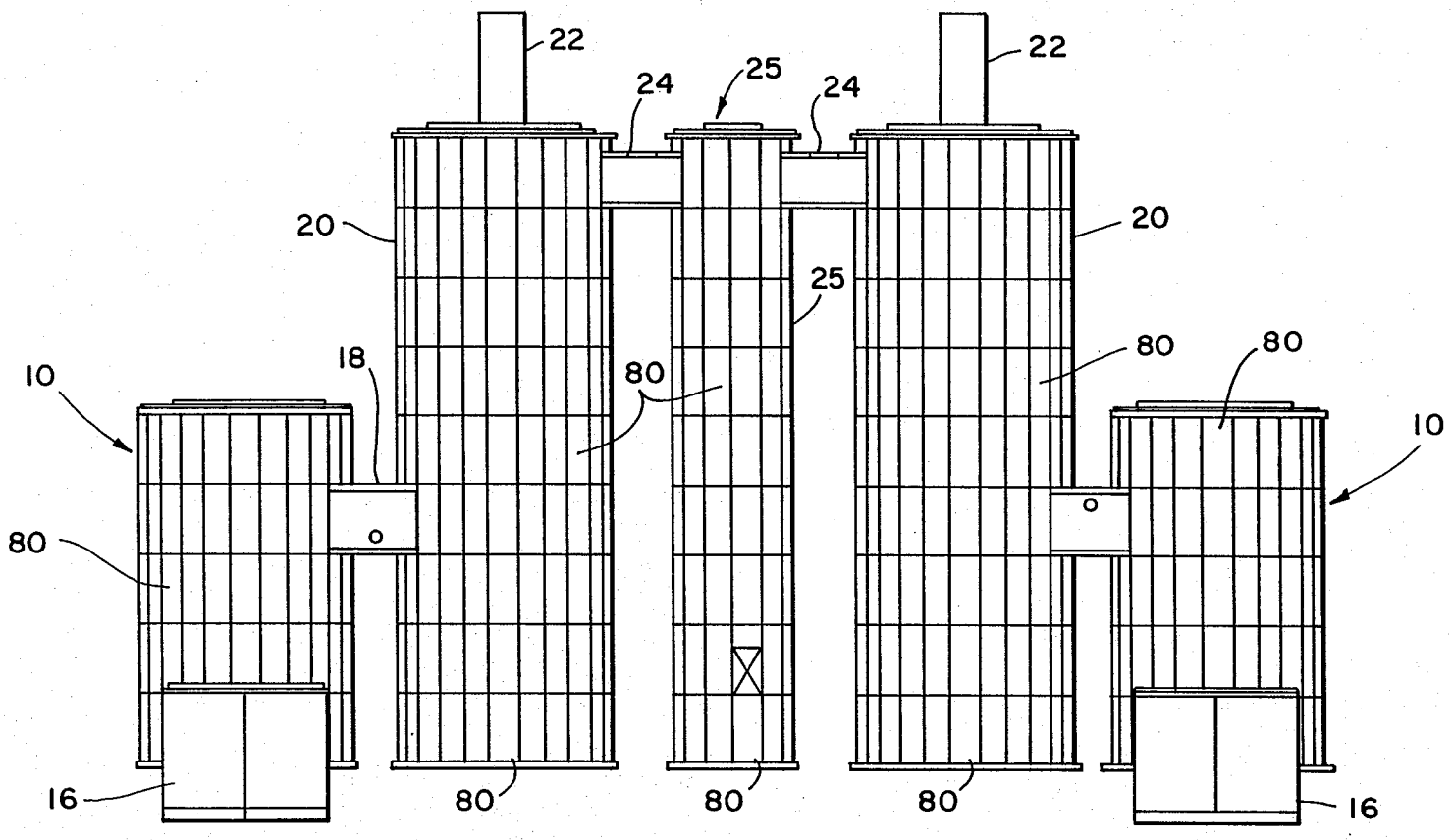
FIG. 2 is a diagrammatic front elevation view of the major components of the waste fuel incinerator system with the pollution control device and chimney removed from the foreground for visibility.
Figure 3:
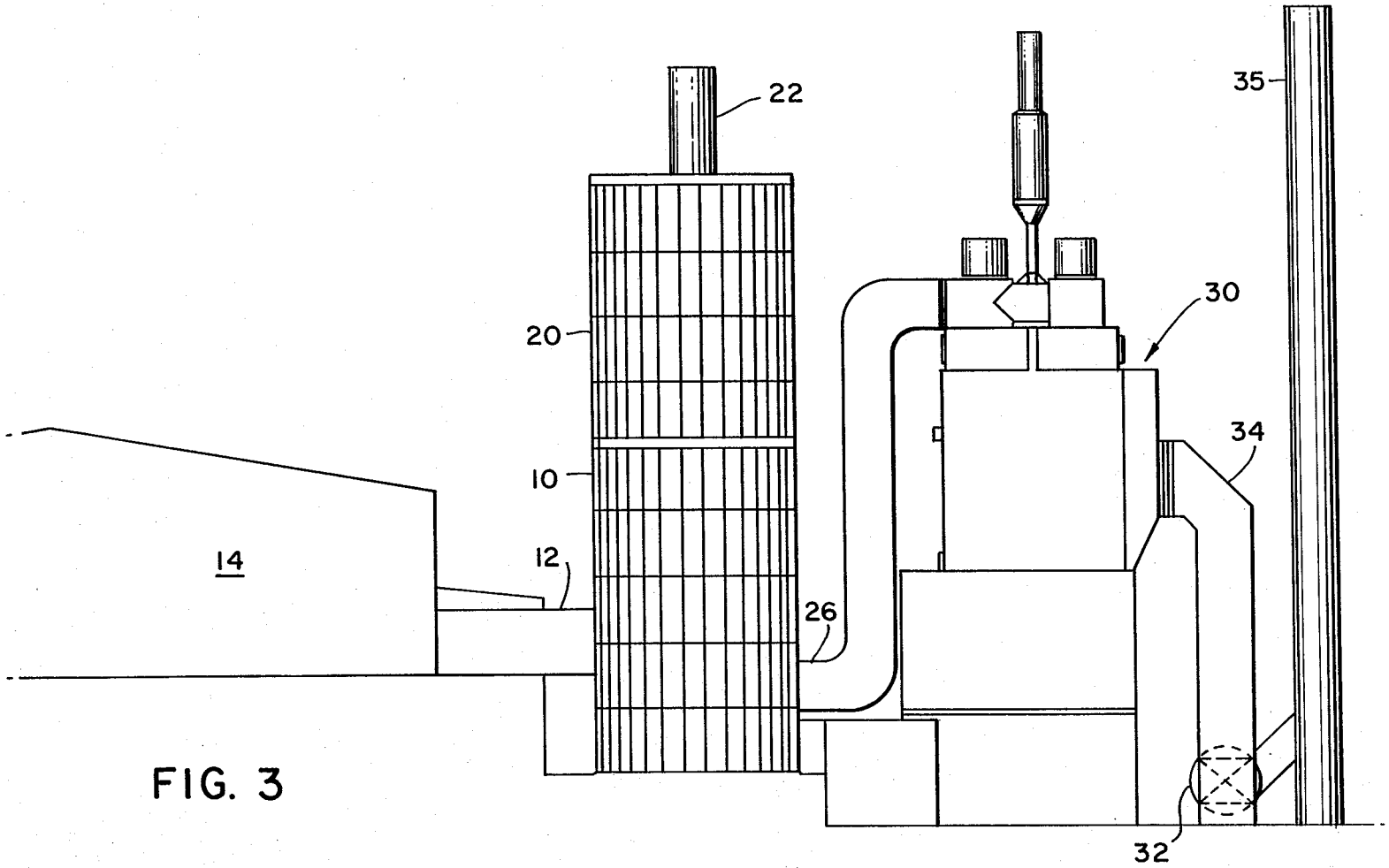
FIG. 3 is a side elevation view of major components including the electrostatic filter bed pollution control device and final chimney.

An overview of a waste fuel incineration system facility according to the invention is illustrated in FIG. 1 with side views of the facility in FIGS. 2 and 3. The exemplary waste fuel incinerator facility of FIGS. 1–3 is actually a dual facility with duplicate incinerators on either side leading to the central pollution control equipment. As shown in FIGS. 1–3 the dual system includes primary combustion chambers 10 on the outboard sides of the system. Each primary chamber 10 includes a waste fuel feed passageway 12 with accompanying waste fuel feed equipment hereafter described housed in the waste fuel receiving and storage building 14. An ash disposal passageway 15 leads from each primary chamber to an ash pit 16 where ashes are stored for cooling and subsequent transport and disposal.

A primary crossover passageway 18, referred to as the primary crossover, leads from an upper level of each of the primary chambers 10 to a separate secondary combustion chamber or secondary tower 20. The flue gasses or exhaust gasses from primary combustion of waste fuel pass through the primary crossovers into the respective secondary towers 20 and upward through the secondary towers. The secondary towers 20 include as a safety feature the normally closed dumpstack 22 hereafter described. The exhaust gasses from primary and secondary combustion pass from the top of the two secondary towers 20 through secondary crossover passageways 24 referred to as secondary crossovers to the top of cooling tower 25. The secondary crossovers 24 include as a safety feature normally open safety dampers hereafter described, operatively coupled to the dumpstacks 22 for automatically closing when the dumpstack damper opens in response to temperature safety limits.

The cooling tower 25 includes spray lances for spraying cooling material such as water for cooling flue gasses drafted downward through the cooling tower 25 to an outlet passageway 26 at the base of the cooling tower. The cooling tower outlet passageway 26 directs flue gasses to the top of a pollution control device, in this example an electrostatic filter bed 30. An induced draft fan 32 in the passageway 34 at the outlet of the pollution control device 30 actively induces a draft of combustion gasses back through the pollution control device electrostatic filter bed 30, cooling tower 25, and secondary towers 20 to the primary combustion chambers 10. The induced draft fan 32 delivers the final flue gasses after primary and secondary combustion, spray cooling and electrostatic filtration to the chimney or stack tower 35 for drafting and dispersing the flue gasses at a desired elevation.

Typically a pressure of 6" to 7" (15–17.5 cm) is established through the system. Accessory outbuildings and equipment 36 are also indicated in FIG. 1.

Figure 4:
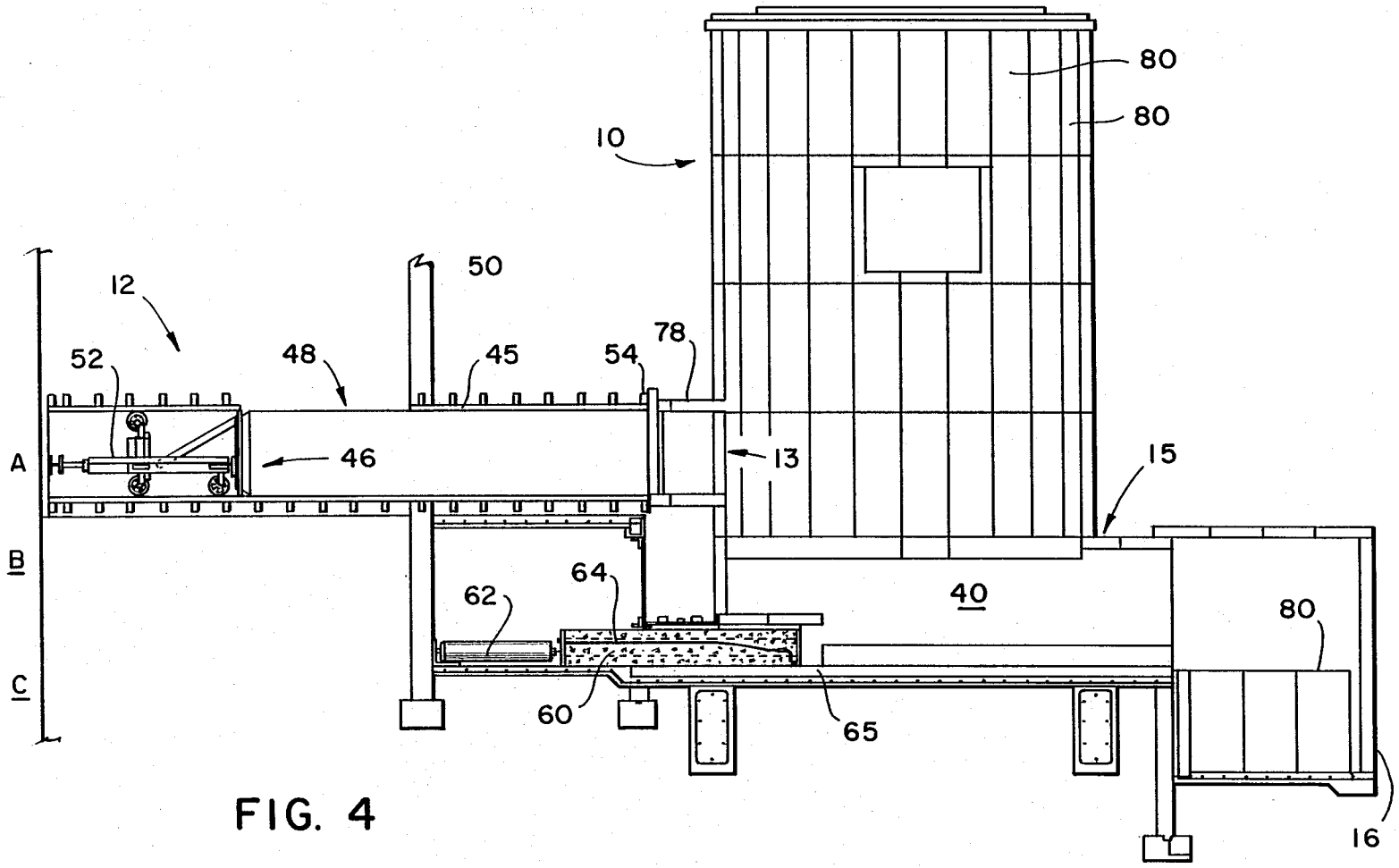
FIG. 4 is a diagrammatic side view of the primary combustion chamber shown with partial breakaway views of the associated waste fuel feed and ash removal arrangements.

The waste fuel feed apparatus and ash removal equipment associated with the primary combustion chamber 10 are illustrated in further detail in FIG. 4. The primary chamber 10 is provided with a waste fuel feeding passageway 12 and inlet 13 at a first upper level A, a waste fuel combustion hearth 40 at a second intermediate level or hearth level B and an ash pit 16 at a third lower level C coupled to an ash tunnel communicating with the primary chamber hearth 40 for receiving and storing ashes. The waste fuel feeding passageway inlet 12, 13 includes a waste fuel feeding cylinder or chute 45 and waste fuel feed "piston" or ram 46 for delivering charges of waste fuel to the primary chamber. The waste fuel feed chute 45 is constructed with a volume capacity defining a charge of waste fuel. A hopper opening 48 with a door 50 is provided for loading the feed chute and closing the hopper opening. The hopper door 50 is operated by the hydraulic door cylinder 51 which is illustrated ahead in FIG. 7.

The waste fuel feed piston 46 is in the form of a ram and double acting, telescoping, hydraulic ram drive or cylinder 52 for extending the ram substantially the length of the feed chute 45 for feeding a charge of waste fuel into the primary chamber 10 through inlet 13 at the upper level A. A 6-section telescoping hydraulic cylinder is used to achieve a stroke of up to 22' (6.7 m). A guillotine door 54 with appropriate construction arrangements isolates the charge of waste fuel in the feed chute 45 from the primary combustion temperatures in the primary chamber 10. Typical dimensions for the feed chute 45 are 5' (1.5 m) wide, 4' (1.2 m) high and 16' (4.9 m) long. One charge of waste fuel consists of approximately 1500 lbs. (681 kg). The overall length of waste fuel feed passageway 12 is approximately, for example, 28' (8.5 m).

An ash ram 60 is positioned at the base of the hearth 40 of primary chamber 10 and an ash ram hydraulic drive 62 advances the ash ram across the base of the hearth as hereafter described for removing ash and slag. Ash and slag are delivered through ash tunnel 15 from the primary chamber 10 to the ash pit 16 at the third lower level C. The ash pit 16 is coupled to the ash tunnel 15 for receiving and storing ashes for subsequent transport and disposal. The ash ram is typically for example 22"×22" (56 cm×56 cm) square in cross section and 11' (3.4 m) long. It is stored in a tunnel at level C under the feed chute 45. The ash pit 16 is typically a concrete building 14'×14' (4.3×4.3 m) and 10' (3 m) high lined with refractory olivine panels 80.

The ash ram 60 which is extended and retracted by double acting hydraulic cylinder 62 may be constructed and molded from concrete, with a steel shell and with appropriate lubricating channels 64 for sliding along a refractory concrete channel 65.

Figure 7:
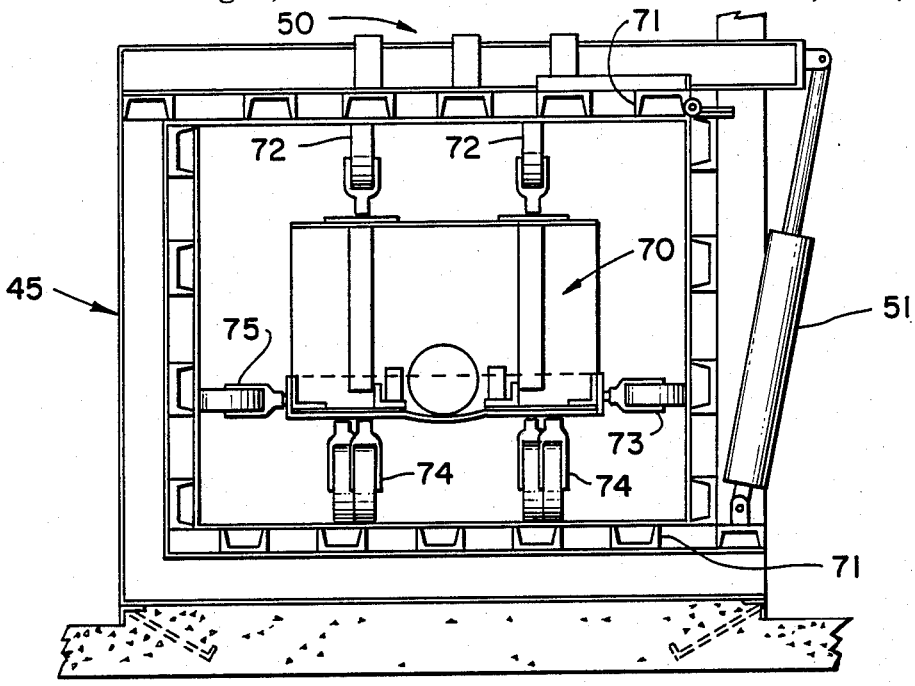
FIG. 7 is a fragmentary end cross-section looking through the waste fuel feed chute or cylinder showing the waste fuel feed ram carriage with casters or rollers on all four sides bearing against the four walls of the feed chute and also showing the waste fuel hopper feed door and hydraulic operating cylinder.

The waste fuel feed passageway and chute 45 as shown in FIGS. 4 and 7 is constructed of steel and stiffened by channel iron and angle iron beams 71 to provide a reinforced framework forming an elongate waste fuel feed cylinder or chute 45 of rectangular cross section. The waste fuel feed ram 46 is formed in complementary rectangular cross section configuration and is delivered by a carriage 70 with wheels or rollers 72, 73, 74 and 75 bearing on all four sides of the cylinder or chute 45 for bearing the irregular forces generated during feeding of heterogeneous waste fuel. The waste fuel feed hydraulic drive cylinder 52 extends the telescoping sections for feeding a charge of waste fuel into the primary combustion chamber. The inlet 13 of the feed chute 45 on the primary chamber hearth side of guillotine door 54 is constructed of meehanite panels 78, a hard refractory cast iron material that can withstand the high temperatures of the primary chamber and abrasion from the waste fuel feed ram 46.

As illustrated in FIGS. 2–4, the primary chambers 10, secondary towers 20 and cooling tower 25 are constructed from molded panels 80 of olivine, a naturally occurring refractory rock material. The olivine is used as an aggregate in refractory cement and molded into panels typically 6 inches (15 cm) thick, 2 ½' (0.76 m) wide and 6' (1.8 m) long. The panels are mounted and retained in a steel frame of angle irons or channel irons and the frames are welded together so that the olivine panel wall is totally self supporting. In the example of FIGS. 1–3 the refractory olivine panel walls are constructed in a faceted circular cross section. Steel I-beams are embedded in the olivine panels that form the flat rooves of the primary chamber and secondary and cooling towers. An example of this type of construction can be found in Applicant's waste fuel incinerator facility presently operating in Frenchville, Maine.

Where surfaces are subject to abrasion or wear, the refractory olivine panels may be combined with other materials. For example at the base of the hearth 40 of primary chamber 10 the refractory trench, channel or track 65 is reinforced with embedded steel wear strips for supporting the ash ram 60 as it advances and retracts. Another location where reinforcement is included is at the inlet end 13 of the waste fuel feed chute 45 on the hearth side of the guillotine door 54 where the walls of the chute are lined with meehanite refractory material to withstand abrasion from the waste fuel feed ram 46. Outside the guillotine door 54 in the low temperature range, the waste fuel feed chute 45 passageways may be formed by steel lining reinforced with the channel iron beams 71 as shown in FIG. 7.

Figure 6:
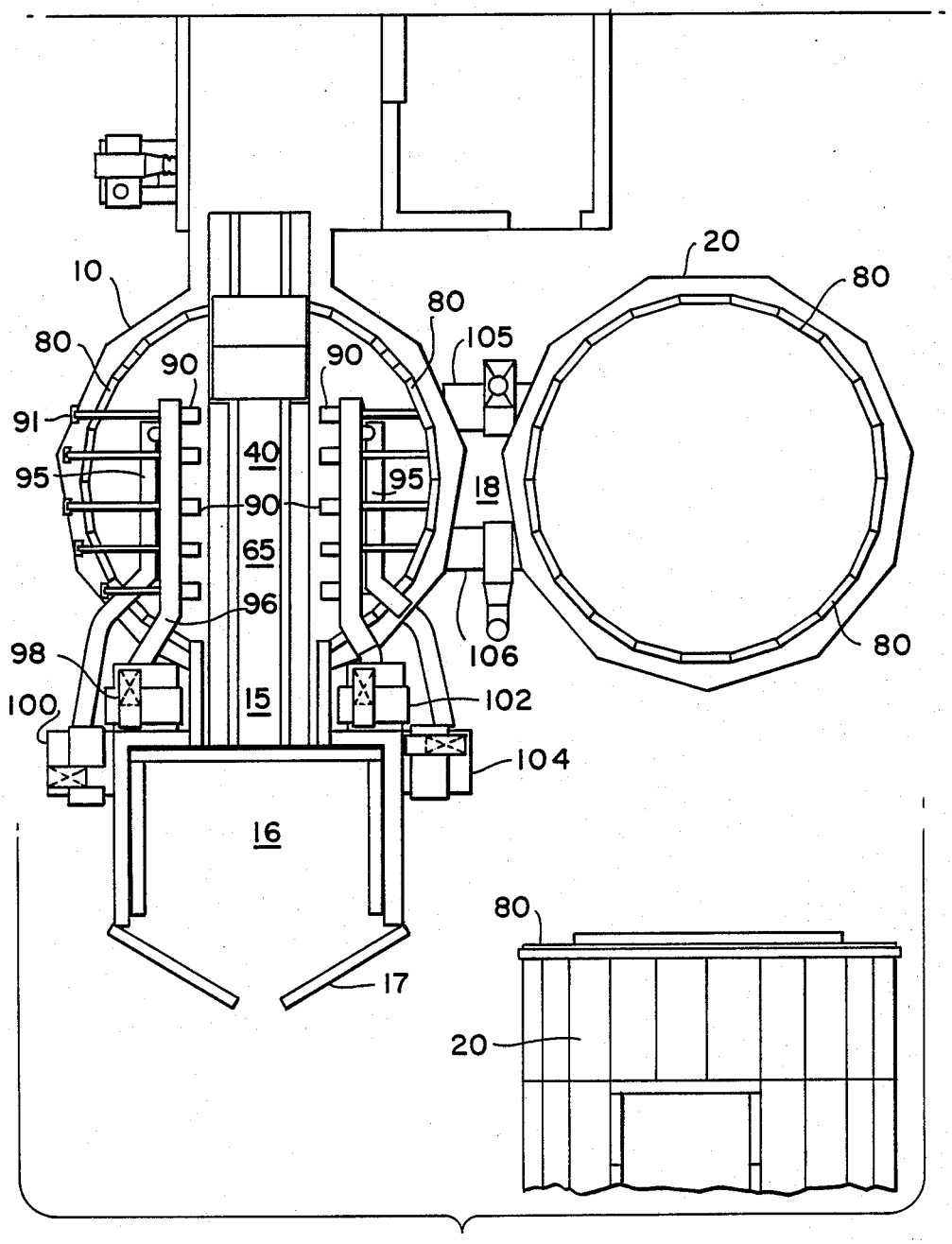
FIG. 6 is a breakaway plan view of the combustion chamber, ash removal arrangements and secondary tower with the upper courses of refractory olivine panels removed showing the layout of under fire air fan/-motor, damper/ motor units and over fire air fan/motor, damper/motor units.

Details of the primary chamber hearth 40 of each primary chamber 10 are illustrated in FIGS. 5A, 5B and 6. The primary chambers are typically for example 18' (5.5 m) in diameter and 30' (9 m) high constructed from the molded refractory olivine panels retained in steel angle iron and channel iron frames. The ash ram 60 of each primary 10 is seated in a channel or trench 65 for reciprocating sliding motion back and forth across the base of the hearth. The channel or trench 65 is constructed from refractory olivine or current material but is lined with embedded steel wear strips, not visible on which the concrete ash ram 60 slides.

The base of each hearth 40 is lined with a "live" gravel bed 85 forming two levels of "V" shaped inclined gravel surfaces. The upper level with first and second inwardly inclined gravel surfaces 86 on either side of the hearth terminate in first and second refractory ledges or shelves 88 also on each side. The shelves or ledges 88 are spaced apart on either side of the ash ram 60 and channel 65 at the base of the hearth 40. The underfire air inlet passageways 90 are positioned and distributed below the respective shelves 88 to distribute and direct underfire air into the combusting fuel at the base of the hearth without interference from the live "V" gravel bed.

The lower level of the "V" shaped gravel bed with first and second inwardly inclined "live" gravel surfaces 92 originates below the shelves 88 and underfire air inlet tubes 90. The lower surfaces 92 slope inwardly to the base of the trench, channel, or track 65 for removal of a layer of gravel with each advance of the ash ram 60.

Waste fuel deposited through the feed chute opening or inlet 13 forms three "strata" in vertical sequence in the hearth. At the upper level approximately 9' (2.7 m) above the floor or base of the hearth is the new charge of "green" fuel below which is the dry, burning fuel. At the base level of the hearth are ashes to be removed. Fuel descends through the sequence by gravity feed from "green," through dry burning to ash. The latter is periodically removed by an extension or pass of the ash ram 60 through the trench or channel 65 and ash tunnel 15 to the ash pit 16 The floor of ash pit 16 is approximately 5' (1.5 m) below the floor of the hearth and the ash pit 16 is provided with doors 17 for truck transport of the ashes.

As the ash ram advances and pushes across the floor of the hearth, the fuel is agitated. Ash along with a layer of gravel on which slag has accumulated is pushed from the base of the primary chamber to the ash pit. The steep but sloping walls 94 of the ash ram trench or channel 65 prevent jamming of material between the ash ram 60 and channel 65. Material instead rolls up the inclined walls 94 and is eventually removed. Because it is the accumulation of melted slag that typically destroys the fixed bed or floor of a hearth, the "live" "V" shaped gravel bed according to the invention cannot be damaged. Instead the live fluid bed is continually replaced as slagged gravel is removed and new gravel added ith fuel through the waste fuel feed chute opening 13. This new gravel, denser than the waste fuel, migrates to the base, forming the upper level "V" surfaces 86 and then the lower level "V" surfaces 92 before the slagged gravel is removed by the ash ram. Upon retraction of the ash ram the fuel is again agitated.

Referring to FIGS. 5A, 5B and 6, underfire air on each side of the hearth is distributed to the respective underfire air inlets or discharge openings 90 below the shelves 88 through a pair of underfire air manifolds 95 and 96. Each manifold on each side is coupled to an underfire air fan/motor and accompanying differential damper/motor unit. The two underfire air fan/motor damper/motor combination units on the left side are designated 98, 100 while the underfire air fan/motor damper/motor units on the right are designated 102, 104. Each unit includes an AEROVENT (Trademark) fan and motor and HONEWELL (Trademark) differential damper and motor and limit switch. The dampers are modulating dampers with logarithmic control, i.e. the greater the signal the more the damper opens. The dampers are automatically controlled by a central controller as hereafter described in response to sensed temperatures determining the quantity of air to be introduced. The control sequence is described below. Each of the underfire air inlets, openings, or passageways 90 also includes a clean out port 91 accessible from the outside of the hearth 40 and primary chamber 10. The distributed arrangement of underfire air passageways, manifolds and separate underfire air fan/motor damper/motor units assures balanced distribution of underfire air from both sides of the hearth.

As shown in FIG. 6, overfire air is injected at the primary crossover 18 leading from each primary chamber 10 to each secondary tower 20. Overfire air is provided by two overfire air fan/motor differential damper motor units 105, 106 coupled to the sides of each crossover passageway 18. Overfire air is used to dilute and to control the temperature of the primary combustion flue gasses as hereafter described. Overfire air may alternatively or in addition be introduced at the top of the primary chamber 10.

The secondary towers 20 having dimensions, for example 18' (5.5 m) in diameter and 54' (16.5 m) in height perform several functions. The impedance of the flow of primary combustion gasses reduces as the mixture of flue gas and overfire air enters the secondary towers 20 from primary crossovers 18. The secondary towers provide a "chimney" draft to the secondary crossovers 24. The residence time of flue gasses in the secondary towers permits completion of combustion, settling of fly ash, and cooling of flue gasses. Flue gasses are typically cooled from 1800° F. (982° C.) leaving each primary chamber to 1200° F. (649° C.) at the top of each secondary tower. The normally closed dump stack 22 at the top of each secondary tower 20 is shown in further detail in FIGS. 8 and 8A. The dump stack 22 is anchored to the top of the respective secondary tower and is maintained closed by normally closed damper 110 mounted for rotation on shaft 112. The dump stack damper 110 is opened by solenoid air cylinders 114 on each side of the stack. The damper 110 is seated within the refractory lining 115 of the stack.

Figure 8A:
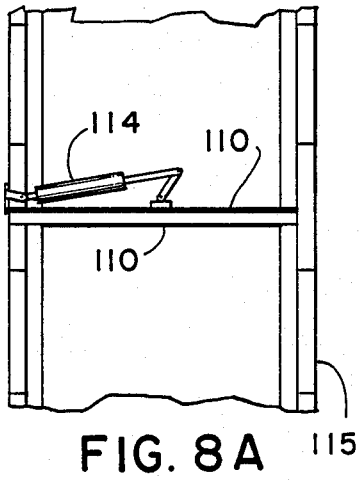
FIG. 8A is a fragmentary side cross-section through the dump stack showing the dump stack damper.
Figure 8:
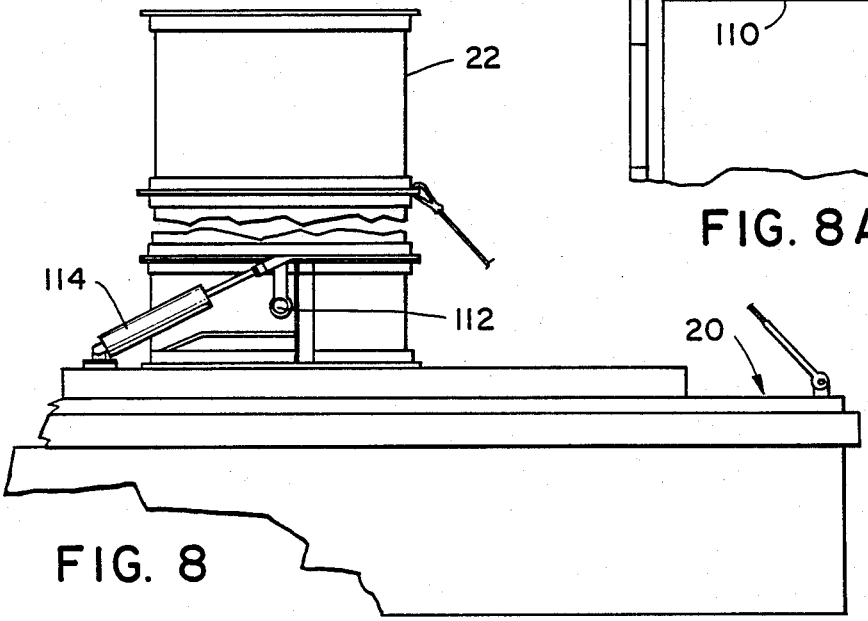
FIG. 8 is a fragmentary side view of the dump stack positioned on the top of the secondary tower and showing the dump stack damper operating cylinder.

A similar damper as illustrated in FIG. 8A is mounted in each of the secondary crossovers 24 leading from the top of the secondary towers 20 to the top of cooling tower 25. However, the secondary crossover dampers are normally open and are coordinated through the control system as hereafter described to close when the normally closed dump stack dampers 110 open.

Referring again to FIGS. 1–3, the single water tower or cooling tower 25 at the center of the facility is approximately 10′ (3 m) in diameter and the same height as secondary towers 20. Flue gasses are drafted from the top of each secondary tower 20 through secondary crossovers 24 to the top of cooling tower 25 and drafted downwardly through the cooling tower to an outlet 26 at the base of the towers 25. The cooling tower is fitted with four SONIC (Trademark) "Water Lances" through the length of the tower for spraying water into the flue gasses. In passing from the top to the bottom of the cooling tower, the flue gasses are typically cooled from approximately 1200° F. (649° C.) to 600° F.(315° C.). The cooling tower 25 is maintained with a dry bottom, spraying just enough water for evaporation before reaching the bottom of the tower.

The combusted and cooled flue gasses then pass through the pollution control device, electrified gravel filter bed 30. The electrostatic filter bed or scrubber is an EFB (Trademark) "Scrubber" with two filter beds of electrified gravel held by screens. The negative gasses pass through constantly moving positive gravel rolling along the screens. Particulates attracted to the gravel are subsequently removed by impact and loss of charge. Induced draft fan 32 with 125 HP (93.2 KW) assures drafting of the combusted, cooled and controlled end product flue gasses through the system to the base of the final dispersing stack 35, in this example a round 4′ (1.2 m) diameter steel stack 64′ (19.5 m) in vertical height.

Figure 9A:
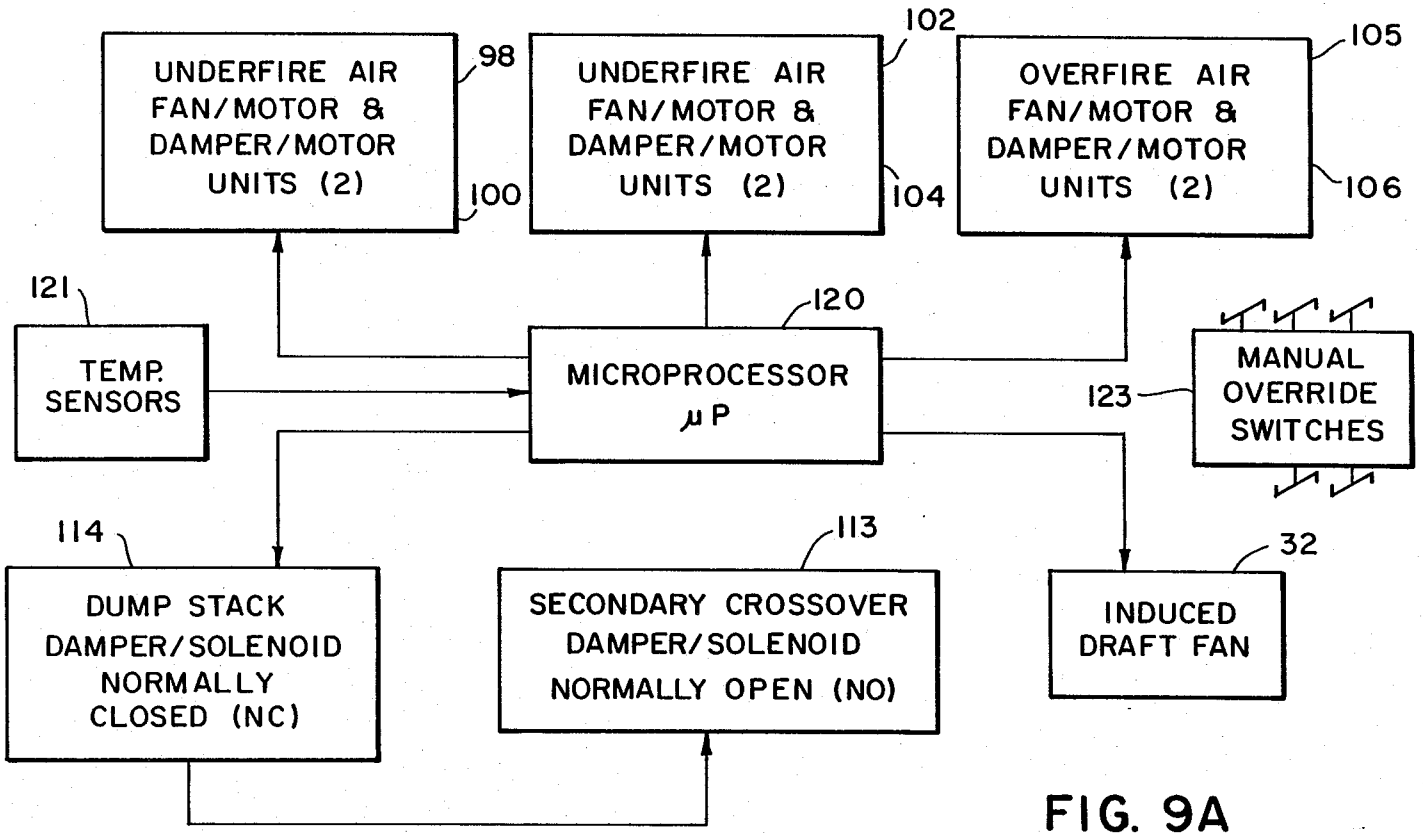
FIGS. 9A and 9B present a block diagram of the electrical operating and control system for the waste fuel incinerator system.
Figure 9B:
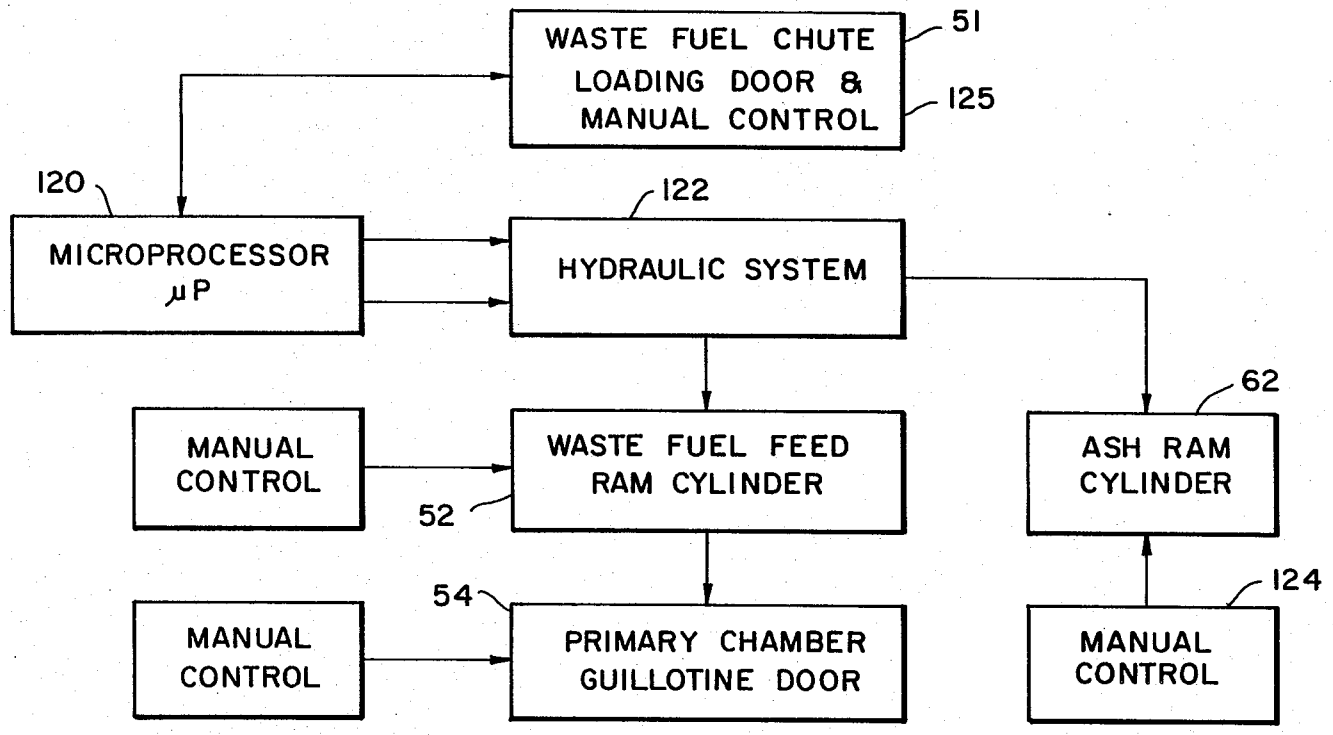

Operation of the waste fuel incineration facility is described with reference to the control system block diagram of FIGS. 9A and 9B and other pertinent Figures. Central control for automated operation is provided for example by microprocessor 120 operatively coupled to: the 2 sets of underfire air fan/motor and differential damper/motor units 98, 100 on the left side of each primary chamber hearth; the 2 sets of underfire air fan/motor and differential damper/motor units 102, 104 on the right side of each primary chamber hearth; the 2 sets of overfire air fan/motor and differential damper/motor units 105, 106 mounted on each primary crossover 18; each normally closed dump stack damper solenoid 114 for dump stacks 22 and each normally open secondary crossover damper 113 for secondary crossovers 24; induced draft fan 32; hydraulic system 122 operating the waste fuel feed ram cylinder 52, primary chamber guillotine door 54 at each primary chamber 10, and the ash ram cylinder 62 with manual override push-button 124 at each primary chamber 10; waste fuel chute loading door cylinder 51 with manual operating push-button 125; and the various temperature sensors.

Temperature sensor thermocouples or probes are provided for safety and control purposes (1) at the top of each primary chamber 10, (2) at the top of each primary crossover 18, (3) at the top of each secondary tower 20, and (4) at the inlet to the central electrostatic gravel filter bed device 30. Temperature probes are also provided inside at the top and bottom of the cooling tower 25 for setting the quantity of water to be sprayed, and inside the electrostatic filter bed scrubber 30 for controlling and setting the electric charge applied to the bed. The latter temperature probes are part of separate autonomous control circuits.

An initial charge of waste fuel and subsequent charges of waste fuel are loaded and fed into the primary chamber in the following sequence. After loading a charge of fuel through the hopper feed chute opening 48 the hopper and feed chute door 50 is closed. Guillotine door 54 is opened and the waste fuel feed ram 46 is advanced by ram telescoping cylinder 52. The feed ram 46 is retracted, guillotine door 54 is closed and the hopper feed chute door 50 can be opened. This automatic sequence may be placed under control of microprocessor 120 or manual override push-buttons can be used to implement selected steps of the sequence. If the primary chamber has recently been in operation, the recent fire ignites the new charge of fuel. Otherwise the fuel is manually ignited with paper through a primary chamber hatch.

Initially at low temperatures, all air fan/motor and air fan damper/motor units are off. The operator initially manually turns on the underfire air fan/motor and damper/motor units or the control program automatically turns on the units when 700° F. (371° C.) is sensed by the temperature probe at the top of the primary chamber. Operation of the air fan/motors and differential dampers/motors determining how much underfire air comes into the primary is then controlled by the central controller program or microprocessor program 120 as follows. At 1000° F. (537° C.) this on-line control sequence commences.

The operation of the fan/motor, damper/motor units is as follows. Each fan and fan motor is associated with a damper and damper motor referred to as a differential damper for varying the volume rate of flow of air over a continuous range. When the damper is completely closed a limit switch shuts down the corresponding fan motor of the unit. When the damper motor opens the damper the respective fan turns on. If the power is turned off, the dampers close.

In the automatic sequence mode at the threshold temperature of 700° F. (371° C.) the damper motors for the underfire air units 98, 100, 102 and 104 are actuated to open the respective dampers just enough to turn on the respective underfire air fan motors and keep them on. Further phycial opening of the differential dampers of the underfire air units or increasing or decreasing underfire air is controlled by the central controller or microprocessor 120 in response to sensed temperatures in the primary chamber. Further differential opening of the underfire air dampers begins when the primary combustion chamber temperature reaches the "at load" temperature of 1000° F. (538° C). Bypass switches 123 are also provided for bypassing the automatic operating mode with manual mode operation.

The microprocesor 120 is programmed to modulate the differential dampers for underfire air in response to the sensed temperature in the primary chamber. The logarithmic control of the damper motors causes the damper to open incrementally with increased signal and close incrementally with decreased signal to maintain combustion in the primary combustion chamber in a normal operating range of 1600°-1800° F. (871°-982° C.). According to the control program the underfire air differential dampers are incrementally closed and finally turned off in a first over-temperature range extending from 1800°-2000° F. (982°-1093° C.). If sensed temperature continues to climb in the primary chamber above the first over-temperature range into a second over-temperature range of approximately 2000°-2100° F. (1093°-1143° C.), the overfire air fan/motor and damper/motor units 105, 106 are turned on at 2000° F. (1093° C.) and increased through the second temperature range up to 2100° F. (1143° C.). At the absolute over-temperature of approximately at least 2100° F. (1149° C.) the central controller or microprocessor 120 shuts down all the underfire air units 98, 100, 102, and 104, overfire air units 105, 106 and waste fuel feed ram cylinder 52. At the absolute over-temperature range an alarm also sounds to alert the operator to any further manual intervention.

At the preferred operating temperature of approximately 1800° F., a burn rate of approximately 5 to 6 tons per hour of waste fuel is required. At the operating temperatures the underfire air units 98, 100, 102 and 104, underfire air manifolds 95, 96 and underfire air inlet passageways 90 are sized to provide excess underfire air, that is a volume rate of air flow in the range of approximately 150% to 250% of the stoichiometric requirement for complete combustion. The central controller program or microprocessor program is arranged to achieve the preferred or target primary combustion temperature of 1800° F. (982° C.) or a preferred primary combustion temperature range of 1700°-1800° F. (927°-982° C.).

According to another phase of the control system the normally closed dumpstack damper solenoid 114 is intercoupled with the normally open secondary crossover damper. In response to signals from one of the temperature sensors or probes 121 at the input to the pollution control device electrostatic filter bed, the central controller or microprocessor 120 compares the measured temperature of flue gas with the safety limit temperature for the device. If the temperature exceeds the safety limit for the device, for example 600° F. (315° C.), the central controller 120 automatically shuts down the electrostatic filter bed 30 shuts down the induced draft fan 32, opens the normally closed dumpstack damper/solenoid 114 and closes the normally open secondary crossover damper/solenoid. Thus, at the safety limit or the pollution control device flue gas is exhausted harmlessly from the top of the secondary tower. Similarly in the event of power failure in the delivery of power to the components of the incinerator facility, the dumpstack damper is set to open while the secondary crossover passageway damper closes. As a result flue gasses from smoldering or paralysis of waste fuel during the power failure condition is vented by the natural draft through the secondary tower and dumpstack. The countervailed normally closed dumpstack damper which opens in the absence of power and the countervailed normally open secondary crossover damper that closes in the absence of power are intended to provide a failsafe system.

During operation of the incinerator facility an operator observes the furnace conditions and retains a number of manual override options for controlling the furnace conditions. Increased temperature in the primary combustion chamber may be achieved by adding additional waste fuel, increasing underfire air, or agitating the combusting fuel using the ash ram. Similarly, to decrease temperature in the primary combustion chamber options include closing down the underfire air unit dampers, turning off the underfire air unit fan/motors, and turning on and increasing the overfire air units. When the system is in normal operation at target temperatures, the final temperature of combusted, cooled and controlled flue gasses is in the range of approximately 400°-500° F. (204°-260° C.). Volume reduction of the waste fuel by combustion is in the range of 85%-95%.

While the invention has been described with reference to particular example embodiments it is intended to cover all modifications and equivalents within the scope of the following claims.

We claim:

1. A method of waste fuel incineration comprising:

loading waste fuel into an elongate waste fuel feed chute forming a waste fuel feed cylinder having a volume capacity defining a charge of waste fuel;

feeding a charge of waste fuel from the feed cylinder into a primary combustion chamber by advancing a ram or piston through the feed cylinder positioned at a first upper level above a hearth of the primary combustion chamber, said hearth forming a second intermediate level or hearth level;

igniting and combusting the waste fuel;

blowing under fire air at multiple locations at approximately the hearth level into the waste fuel at a threshold primary combustion temperature and increasing the under fire air to a level blowing excess under fire air at a volume rate in the range of approximately 150% to 250% of the stoichiometric requirement for complete combustion during operation of the primary combustion chamber at normal load;

exhausting flue gasses from the primary combustion chamber through a first cross-over passageway into a secondary tower and drafting flue gas upward through the secondary tower;

sensing the temperature of flue gasses from primary combustion and controlling the flow of under fire air to maintain primary combustion temperature in the primary combustion chamber at a target temperature in the temperature range of approximately 1600°-1800° F. (871°-982° C.);

introducing over fire air into the flue gasses from primary combustion for diluting and cooling flue gasses if the sensed temperature falls within an over temperature range above the target temperature;

exhausting flue gasses at the top of the secondary tower through a second crossover passageway to the top of a cooling tower, drafting the flue gasses downward to the base of the cooling tower, and spraying the descending flue gasses with cooling material, cooling the flue gasses;

passing the flue gasses through a pollution control device for reducing particulate emissions;

inducing a draft through the system from the primary combustion chamber using an induced draft fan following the outlet of the pollution control device and delivering the flue gasses to a chimney for drafting and disbursal at a desired elevation;

removing ash and slag from the hearth of the primary combustion chamber by advancing an ash ram across the base of the hearth, passing the ash and slag through an ash tunnel, and depositing the ash and slag in an ash pit at a third lower level.

2. The method of claim 1 wherein the step of blowing under fire air comprises introducing the under fire air through multiple under fire air passageways distributed at the hearth level and balancing the distribution of under fire air introduced into the fuel on each side of the hearth.

3. The method of waste fuel incineration of claim 1 comprising the further steps for combustion temperature control of:

sensing the temperature of flue gasses from primary combustion;

comparing the temperature with a target primary combustion temperature in the range of approximately 1600°-1800° F. (871°-982° C.);

incrementally damping down and reducing the flow of the under fire air as the combustion temperature exceeds the target temperature in a first over-temperature range extending above the target temperature, and turning off the under fire air at the top of the first over-temperature range;

turning on and blowing over fire air into the flue gasses of primary combustion to cool and dilute the flue gasses if the sensed temperature falls within a second over-temperature range extending above the first over-temperature range;

and shutting down the under fire air, the over fire air, and the waste fuel feeding, causing a starved air condition of smoldering in the primary combustion chamber for lowering the temperature of primary combustion if the sensed temperature exceeds an absolute over-temperature.

4. The method of claim 3 wherein the first over-temperature range comprises approximately 1800°-2000° F. (982°-1093° C.), wherein the second over-temperature range comprises approximately 2000°-2100° F. (1093°-1149° C.), and wherein the absolute over-temperature is at least 2100° F. (1149° C.).

5. The method of claim 3 wherein the target temperature is in the range of approximately 1700°-1800° F. (927°-982° C.).

6. The method of claim 5 wherein the target temperature is approximately 1800° F. (982° C.).

7. The method of claim 4 wherein the target temperature is in the range of approximately 1700°-1800° F. (927°-982° C.).

8. The method of waste fuel incineration of claim 1 comprising the further steps in the event of electrical power failure of:

automatically opening a normally closed dump stack damper at the top of the secondary tower and directly gravity drafting secondary flue gasses to the atmosphere through a dump stack at the top of the secondary tower;

and automatically closing a normally open second cross-over damper in the second cross-over passageway between the secondary tower and the cooling tower thereby confining drafting of flue gasses to the dump stack.

9. The method of claim 3 comprising the steps of;

sensing temperature of flue gasses passing from the cooling tower to the pollution control device;

comparing the temperature with a pollution control device safety limit temperature;

turning off the induced draft fan and automatically opening a normally closed dump stack damper at the top of the secondary tower and directly gravity drafting secondary flue gasses to the atmosphere through a dump stack at the top of the secondary tower if the temperature exceeds the pollution control device safety limit temperature;

and at the same time automatically closing a normally open second cross-over damper in the second cross-over passageway between the secondary tower and the cooling tower thereby confining drafting of flue gasses to the dump stack.

10. The method of waste fuel incineration of claim 1 comprising the steps of:

providing a live "V" shaped gravel bed hearth with the elongate ash ram positioned at the apex at the base of the "V";

advancing the elongate ash ram along the apex at the base of the "V" shaped gravel bed and removing a layer of gravel with slag formed on the gravel along with the ashes;

pushing the ash, slag and gravel mixture through an ash tunnel to the ash pit at the third lower level;

and replenishing the gravel forming the "V" shaped gravel bed.

11. The method of claim 10 wherein the step of replenishing the gravel comprises feeding gravel into the primary combustion chamber through the waste fuel feed cylinder.

12. The method of claim 1 comprising the steps of:

providing an elongate waste fuel feed chute with four sides forming an elongate waste fuel feed cylinder of rectangular cross-section;

and advancing a ram or piston with rollers bearing on all four sides of the cylinder for bearing irregular forces generated during feeding heterogeneous waste fuel.

13. The method of claim 12 comprising the step of isolating a charge of waste fuel in the waste fuel feed cylinder from the primary combustion chamber by automatically operating a guillotine door adjacent to the primary combustion chamber and the end of the waste fuel feed cylinder.

14. The method of claim 11 wherein the ram or piston comprises multiple telescoping sections and wherein the step of advancing the ram or piston comprises telescoping or extending the sections.

15. The method of claim 1 comprising the further steps for combustion temperature control of:

sensing the temperature of flue gasses from primary combustion;

comparing the sensed temperature with a target primary combustion temperature in the operating range of approximately 1600°-1800° F. (871°-982° C.) and taking any of the following steps if the combustion temperature is below the target temperature;

incrementally increasing the flow of under fire air;

feeding additional charges of fuel into the primary combustion chamber;

and advancing the ash ram to agitate the waste fuel and increase combustion.

16. A method of waste fuel incineration comprising:

loading waste fuel into an elongate waste fuel feed chute forming a waste fuel feed cylinder having a volume capacity defining a charge of waste fuel;

feeding a charge of waste fuel from the feed cylinder into a primary combustion chamber by advancing a ram or piston through the feed cylinder positioned at a first upper level above a hearth of the primary combustion chamber, said hearth forming a second intermediate level or hearth level;

igniting and combusting the waste fuel;

blowing under fire air at multiple locations at approximately the hearth level into the waste fuel at a threshold primary combustion temperature and increasing the under fire air to a level blowing excess under fire air at a volume rate in the range of approximately 150% to 250% of the stoichiometric requirement for complete combustion during operation of the primary combustion chamber at normal load;

sensing the temperature of flue gasses from primary combustion and controlling the flow of under fire air to maintain primary combustion temperature in the primary combustion chamber at a target temperature in the temperature range of approximately 1600°-1800° F. (871°-982° C.);

exhausting flue gasses from the primary combustion chamber through a first cross-over passageway into a secondary tower, drafting flue gas upward through the secondary tower, settling fly ash, substantially completing combustion with the excess air, and radiating and cooling the flue gasses;

passing the flue gasses through a pollution control device for reducing particulate emissions;

inducing a draft through the system from the primary combustion chamber using an induced draft fan following the outlet of the pollution control device and delivering the flue gasses to a chimney for drafting and disbursal at a desired elevation;

removing ash and slag from the hearth of the primary combustion chamber by advancing an ash ram across the base of the hearth, passing the ash and slag through an ash tunnel, and depositing the ash and slag in an ash pit at a third lower level;

incrementally damping down and reducing the flow of the under fire air as the combustion temperature exceeds the target temperature in a first over temperature range extending above the target temperature, and turning off the under fire air at the top of the first over temperature range;

turning on and blowing over fire air into the flue gasses of primary combustion to cool and dilute the flue gasses if the sensed temperature falls within a second over-temperature range extending above the first over-temperature range;

shutting down the under fire air, the over fire air, and the waste fuel feeding, causing a starved air condition of smoldering in the primary combustion chamber for lowering the temperature of primary combustion flue gasses if the sensed temperature exceeds an absolute over-temperature at the top of the second over-temperature range;

automatically opening a normally closed dump stack damper at the top of the secondary tower and directly gravity drafting secondary flue gasses to the atmosphere through a dump stack at the top of the secondary tower in the event of electrical power failure, and at the same time automatically closing a normally open damper in the second cross-over passageway between the secondary tower and the cooling tower thereby confining drafting of the flue gasses to the dump stack;

sensing a second temperature of flue gasses passing from the cooling tower to the pollution control device;

comparing the second temperature with a pollution control device safety limit temperature;

and automatically opening the normally closed dump stack damper and automatically closing the normally open second cross-over passageway damper if the second temperature exceeds the pollution control device safety limit temperature.

17. The method of claim 16 wherein the first over-temperature range comprises approximately 1800°-2000° F. (982°-1093° C.), wherein the second over-temperature range comprises approximately 2000°-2100° F. (1093°-1149° C.), and wherein the absolute over-temperature is at least 2100° F. (1149° C.).

18. A system for waste fuel incineration comprising:

a primary combustion chamber having a fuel feeding inlet at a first upper level and a waste fuel combustion hearth at a second intermediate level or hearth level;

a plurality of under fire air inlet passageways positioned at the hearth level of the primary combustion chamber for introducing under fire air into waste fuel on the hearth during combustion, a plurality of fans and fan motors respectively coupled to the under fire air inlet passageways for blowing under fire air, and a plurality of dampers and damper motors operatively positioned for differentially controlling the volume rate of flow of under fire air through the respective under fire air inlet passageways, said under fire air inlets being distributed for balanced flow of air at the hearth level into the waste fuel, said under fire air inlet passageways, fans and fan motors, and dampers and damper motors being constructed and arranged for delivering 150% to 250% of the stoichiometric requirement for complete combustion of waste fuel during operation of the primary combustion chamber at normal load;

over fire air inlet passageway means positioned in the pathway of flue gasses from primary combustion, fan means and fan motor means operatively coupled to the over fire air inlet passageway means for blowing over fire air, and damper means and damper motor means operatively positioned for differentially controlling the volume rate of flow of over fire air for cooling and diluting flue gasses;

a waste fuel feeding cylinder and piston, said cylinder comprising an elongate waste fuel feed chute having a volume capacity defining a charge of waste fuel, a hopper opening for loading the feed chute and a door for closing the hopper opening, said piston comprising a ram and ram drive means for extending the ram substantially the length of the feed chute for feeding a charge of waste fuel into the primary combustion chamber at the upper level;

an ash ram positioned at the base of the hearth of the primary combustion chamber and ram drive means for advancing the ash ram across the base of the hearth for removing ash and slag;

a secondary tower and a first cross-over passageway from the primary combustion chamber to the secondary tower, said secondary tower having diameter, height and volume dimensions for drafting flue gasses upward through the secondary tower;

a dump stack and dump stack damper positioned at the top of the secondary tower, said dump stack damper being normally closed to prevent natural draft through the dump stack and constrain the draft of flue gasses to the second cross-over passageway;

a cooling tower and a second cross-over passageway from the top of the secondary tower to the top of the cooling tower, said cooling tower comprising spray means for spraying cooling material for cooling flue gasses drafted through the cooling tower, said cooling tower being formed with an outlet at the base of the cooling tower;

a safety damper positioned in the second cross-over passageway, said safety damper being normally open for drafting flue gasses from the secondary tower through the cooling tower, said safety damper being operatively coupled to the dump stack damper for automatically closing when the dump stack damper opens;

a pollution control device operatively coupled to the flue gas outlet at the base of the cooling tower;

induced draft fan means for actively inducing a draft through the pollution control device, cooling tower, and secondary tower from the primary combustion chamber;

first temperature sensor means operatively positioned for sensing the temperature of flue gasses from primary combustion;

and first control means operatively coupled to the under fire air fan motors, under fire air damper motors, over fire air fan motor means, over fire air damper motor means, and waste fuel feeding cylinder and piston, said first control means being operatively programmed for maintaining the primary combustion temperature in the primary combustion chamber at a target temperature selected in the range of approximately 1600°-1800° F. (871°-982° C.), for turning on and increasing under fire air to bring the primary combustion chamber flue gasses up to the target temperature, for maintaining the volume rate of flow of under fire air at 150% to 250% of the stoichiometric requirement for complete combustion at normal load, for reducing and turning off under fire air in a first over-temperature range extending above the target temperature, for turning on and increasing over fire air in a second over-temperature range extending above the first over-temperature range, and for shutting down the under fire air, over fire air and waste fuel feeding cylinder and piston at a selected absolute over-temperature.

19. The system of claim 18 wherein the hearth comprises a live "V" shaped gravel bed hearth with the elongate ash ram positioned at the apex at the base of the "V", means for advancing the elongate ash ram along the apex at the base of the "V" shaped gravel bed for removing a layer of gravel and slag formed on the gravel along with ashes, said mixture of ash, slag and gravel being pushed by the ash ram for storage in the ash pit.

20. The system of claim 18 wherein the elongate waste fuel feed chute is formed with four sides forming an elongate waste fuel feed cylinder of rectangular crosssection, wherein the waste fuel feed ram is formed in complementary rectangular cross-section configuration with rollers mounted on all four sides bearing on all four sides of the cylinder for bearing irregular forces generated during feeding of heterogeneous waste fuel.

21. The system of claim 20 wherein the waste fuel feed ram comprises a telescoping ram of multiple telescoping sections and wherein the ram drive means extends the telescoping sections for feeding a charge of waste fuel into the primary combustion chamber.

22. The system of claim 18 wherein the first control means is programmed with a first over-temperature range comprising approximately 1800°-2000° F. (982°-1093° C.), a second over-temperature range comprising approximately 2000°-2100° F. (1093°-1149° C.) and an absolute over-temperature selected to be at least approximately 2100° (1149° C.).

23. The system of claim 21 wherein the first control means is programmed with a target temperature for primary combustion of approximately 1800° F. (982° C.).

24. The system of claim 18 having a second control means intercoupling the normally closed damp stack damper, the normally open second cross-over damper, induced draft fan means, and pollution control device, and further comprising a second temperature sensing means positioned in the vicinity of the pollution control device for determining flue gas temperature at the pollution control device and comparing it with a safety limit temperature, said second temperature sensing means and second control means being operatively coupled to turn off the induced draft fan means, open the dump stack damper, close the second cross-over damper and turn off the pollution control device at said safety limit temperature.

25. The system of claim 24 wherein the second control means is operatively coupled to a source of electrical power so that upon a power failure the normally closed dump stack damper automatically opens and the normally open second cross-over damper automatically closes.

26. The system of claim 24 wherein the second control means is operatively coupled to the induced draft fan means so that the normally closed dump stack damper automatically opens and the normally open second cross-over damper automatically closes if the induced draft fan means turns off.

27. The system of claim 18 wherein the pollution control device comprises an electrostatic filter gravel bed and wherein the safety temperature is set at a temperature no greater than approximately 800° F. (427° C.).

28. The system of claim 18 wherein the first temperature sensing means is positioned in the first cross-over passageway.

29. The system of claim 18 wherein the over fire air inlet passageway is positioned for delivering over fire air into the first cross-over passageway downstream from the first temperature sensing means.

30. The system of claim 18 wherein the hearth comprises a double "V" gravel bed hearth having an upper level "V" shaped bed of first and second inwardly inclined gravel sides terminating in respective first and second laterally spaced apart ledges or shelves, said shelves being laterally spaced apart above the path of travel of the ash ram, said under fire air inlet passageways being positioned below the respective shelves thereby avoiding interference from the gravel, and a lower level "V" shaped gravel bed of first and second inwardly inclined gravel sides below the respective shelves and under fire air passageways, said lower level inwardly inclined gravel sides sloping into the path of travel of the ash ram for removal of a layer of gravel with each advance of the ash ram.

31. A system for waste fuel incineration comprising:

a primary combustion chamber having a fuel feeding inlet at a first upper level and a waste fuel combustion hearth at a second intermediate level or hearth level;

a plurality of under fire air inlet passageways positioned at the hearth level of the primary combustion chamber for introducing under fire air into waste fuel on the hearth during combustion, a plurality of fans and fan motors respectively coupled to the under fire air inlet passageways for blowing under fire air, and a plurality of dampers and damper motors operatively positioned for differentially controlling the volume rate of flow of under fire air through the respective under fire air inlet passageways, said under fire air inlets being distributed for balanced flow of air at the hearth level into the waste fuel, said under fire air inlet passageways, fans and fan motors, and dampers and damper motors being constructed and arranged for delivering 150% to 250% of the stoichiometric requirement for complete combustion of waste fuel during operation of the primary combustion chamber at normal load;

over fire air inlet passageway means positioned in the pathway of flue gasses from primary combustion, fan means and fan motor means operatively coupled to the over fire air inlet passageway means for blowing over fire air, and damper means and damper motor means operatively positioned for differentially controlling the volume rate of flow of over fire air for cooling and diluting flue gasses;

first temperature sensor means operatively positioned for sensing the temperature of flue gasses from primary combustion; and first control means operatively coupled to the under fire air fan motors, under fire air damper motors, over fire air fan motor means, and over fire air damper motor means, said control means being operatively programmed for maintaining the primary combustion temperature in the primary combustion chamber at a target temperature selected in the range of approximately 1600°–1800° F. (871°–982° C.), for turning on and increasing under fire air to bring the primary combustion chamber flue gasses up to the target temperature, for reducing and turning off under fire air in a first over-temperature range extending above the target temperature, for maintaining the volume rate of flow of under fire air at 150% to 250% of the stoichiometric requirement for complete combustion at normal load, for turning on and increasing over fire air in a second over-temperature range extending above the first over-temperature range, and for shutting down the under fire air and over fire air at a selected absolute over-temperature.

32. The system of claim 31 comprising:

a secondary tower and a first cross-over passageway from the primary combustion chamber to the secondary tower;

a dump stack and dump stack damper positioned at the top of the secondary tower, said dump stack damper being normally closed to prevent natural draft through the dump stack and constrain the draft of flue gasses to the second cross-over passageway;

a cooling tower and a second cross-over passageway from the top of the secondary tower to the top of the cooling tower, said cooling tower comprising spray means for spraying cooling material for cooling flue gasses drafted through the cooling tower, said cooling tower being formed with an outlet at the base of the cooling tower;

a safety damper positioned in the second cross-over passageway, said safety damper being normally open for drafting flue gasses from the secondary tower through the cooling tower, said safety damper being operatively coupled to the dump stack damper for automatically closing when the dump stack damper opens;

a pollution control device operatively coupled to the flue gas outlet at the base of the cooling tower;

induced draft fan means for actively inducing a draft through the pollution control device, cooling tower, and secondary tower from the primary combustion chamber;

second control means intercoupling the normally closed damp stack damper, the normally open second cross-over damper, induced draft fan means, and pollution control device, and further comprising a second temperature sensing means positioned in the vicinity of the pollution control device for determining flue gas temperature at the pollution control device and comparing it with a safety temperature, said second temperature sensing means and second control means being operatively coupled to turn off the induced draft fan means, open the dump stack damper, close the second cross-over damper and turn off the pollution control device at said safety temperature, said second control means being operatively coupled to a source of electrical power so that upon a power failure the normally closed dump stack damper automatically opens and the normally open second cross-over damper automatically closes.

33. The system of claim 31 wherein the hearth comprises a live "V" shaped gravel bed hearth with the elongate ash ram positioned at the apex at the base of the "V", means for advancing the elongate ash ram along the apex at the base of the "V" shaped gravel bed for removing a layer of gravel and slag formed on the gravel along with ashes, said mixture of ash, slag and gravel being pushed by the ash ram through the ash tunnel for storage in the ash pit.

34. An incinerator hearth for the primary combustion chamber of a waste fuel incinerator which utilizes under fire combustion air in the combustion chamber and an ash ram constructed and arranged with a path of travel across the base of the hearth for removing ashes comprising:

a double "V" shaped gravel bed hearth having an upper level "V" shaped gravel bed of first and second inwardly inclined gravel sides;

first and second laterally spaced apart ledges or shelves, said shelves being spaced apart on either side of the hearth and positioned over the path of travel of the ash ram, said upper level first and second inwardly inclined gravel sides terminating respectively at the first and second spaced apart shelves;

a plurality of under fire air inlet passageways positioned below the respective shelves for blowing under fire air from both sides of the hearth without interference from gravel;

and a lower level "V" shaped gravel bed of third and fourth inwardly inclined gravel sides below the respective shelves and under fire air inlet passageways, said lower level inwardly inclined third and fourth gravel sides sloping into the path of travel of the ash ram for removal of a layer of gravel with each advance of the ash ram.

* * * * *